US006039317A

United States Patent [19]

Kramer

[11] Patent Number: 6,039,317

[45] Date of Patent: Mar. 21, 2000

[54] GRIPPER RELEASING DEVICE SIGNATURE CONVEYOR

[75] Inventor: Felix Kramer, Vordemwald, Switzerland

[73] Assignee: Grapha-Holding AG, Hergiswil, Switzerland

[21] Appl. No.: 08/931,185

[22] Filed: Sep. 16, 1997

[30] Foreign Application Priority Data

Nov. 5, 1996 [CH] Switzerland ..... 19962728

[51] Int. Cl.[7] ..... B65H 29/04

[52] U.S. Cl. ..... 271/204; 270/52.14; 198/470.1; 198/803.7

[58] Field of Search ..... 270/52.14, 52.21, 270/52.25; 198/470.1, 803.7; 271/204, 206

[56] References Cited

U.S. PATENT DOCUMENTS 4,172,514 10/1979 Shantz et al. ..... 198/803.7
5,160,019 11/1992 Temming ..... 198/803.7
5,172,802 12/1992 Wells ..... 198/803.7
5,244,078 9/1993 Silva et al. ..... 198/803.7
5,328,017 7/1994 Carlen ..... 198/803.7

FOREIGN PATENT DOCUMENTS 0 561 308 9/1993 European Pat. Off. ..... B65H 5/14

OTHER PUBLICATIONS

European Search Report for corresponding EP application No. EP 97 81 0808.

*Primary Examiner*—William E. Terrell
*Assistant Examiner*—Patrick Mackey
*Attorney, Agent, or Firm*—Darby & Darby

[57] ABSTRACT

A transport system (1) is provided for removing individual signatures (2) from a transport flow. The system includes grippers (3) which are attached in substantially equal distance therebetween to an endless loop pulling means for holding the signatures (2), and an actuating device (11) causing the grippers (3) to open, with the actuating device (11) displacing a lever arm (13) which is connected to the moveable gripper element (10), to a laterally spaced-apart guide rail (12).

11 Claims, 2 Drawing Sheets

GRIPPER RELEASING DEVICE SIGNATURE CONVEYOR

BACKGROUND OF THE INVENTION

1. Field of the Invention

The present invention relates to an apparatus for transporting signatures with the help of grippers which are attached in substantially equal spacings therebetween to an endless loop pulling means and which can be displaced in an open position by control means counteracting the biasing force of a spring, wherein the control means is provided in form of an actuating device capable of being driven out of its home position and acting on a lever arm of a movable gripping element.

Apparatus of this type have stations placed along a transport path where the signatures can be removed for examination and further processing of the signatures.

2. Description of the Related Art

In a known apparatus of the aforedescribed type, the actuating device was implemented in form of a lever actuating the moveable gripping element, wherein for opening a gripper, the lever is set in motion through a releasable latch with the help of a spring which is biased by a pneumatic piston-cylinder unit.

In this case, because of the sudden stress due to the relatively large forces, the opening system was subjected to severe wear and generated a noise resembling gun fire. In addition, the required control devices add significant complexity.

SUMMARY OF THE INVENTION

It is the object of the present invention to provide an apparatus of the type described above which is not stressed by the abruptly occurring large forces and which does not create a disagreeable noise level.

The object is solved by the invention in that the end of the actuating device facing away from the lever arm of the moveable gripping element is pivotally supported, while between its respective ends, the actuating device is pivotally coupled to a connecting rod which is supported by a revolving crank.

In this way, the forces striking the apparatus and disturbing the surroundings are almost completely eliminated, thereby providing a continuous transition when the grippers begin to open.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention will be described in conjunction with an embodiment and with reference to the drawing to which reference is made for all details not explicitly described in the specification. In the drawings, wherein like reference numerals delineate similar elements throughout the several views.

DETAILED DESCRIPTION OF THE PRESENTLY PREFERRED EMBODIMENTS

Figure 1:
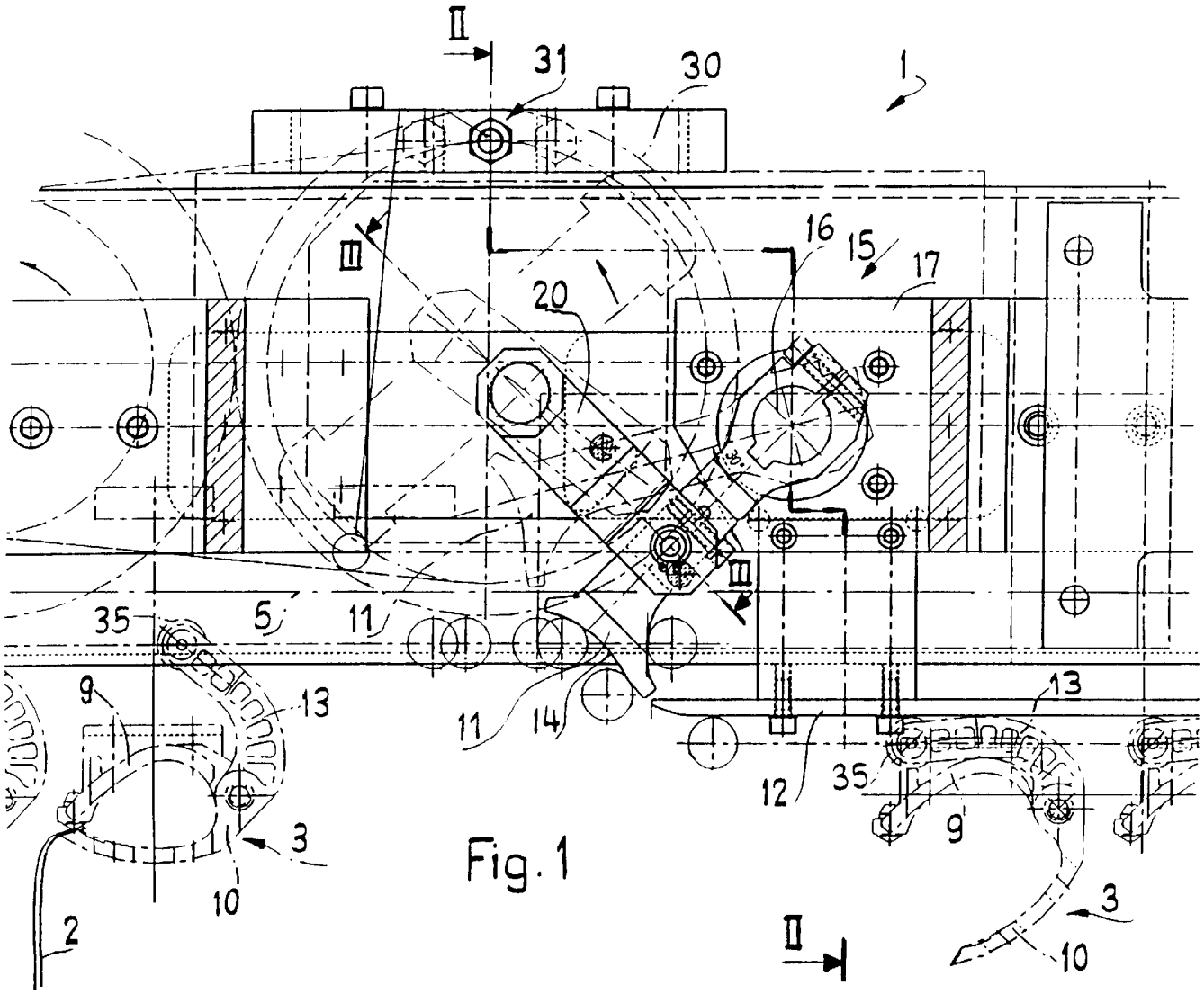
FIG. 1 is a view of an embodiment of the invention.
Figure 2:
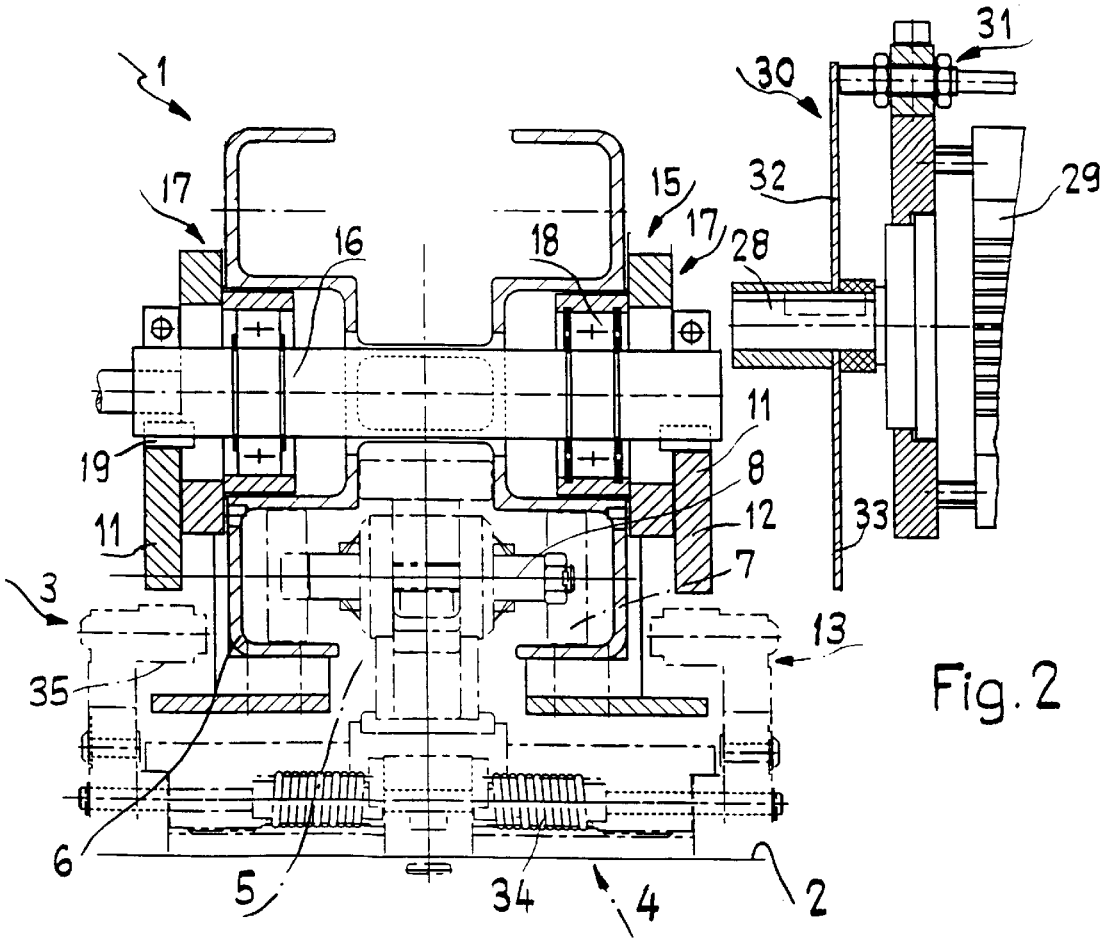
FIG. 2 a cross-sectional view through the embodiment along the line II—II of FIG. 1, and FIG. 3 a sectional view through the embodiment along the line III—III of FIG. 1.
Figure 3:
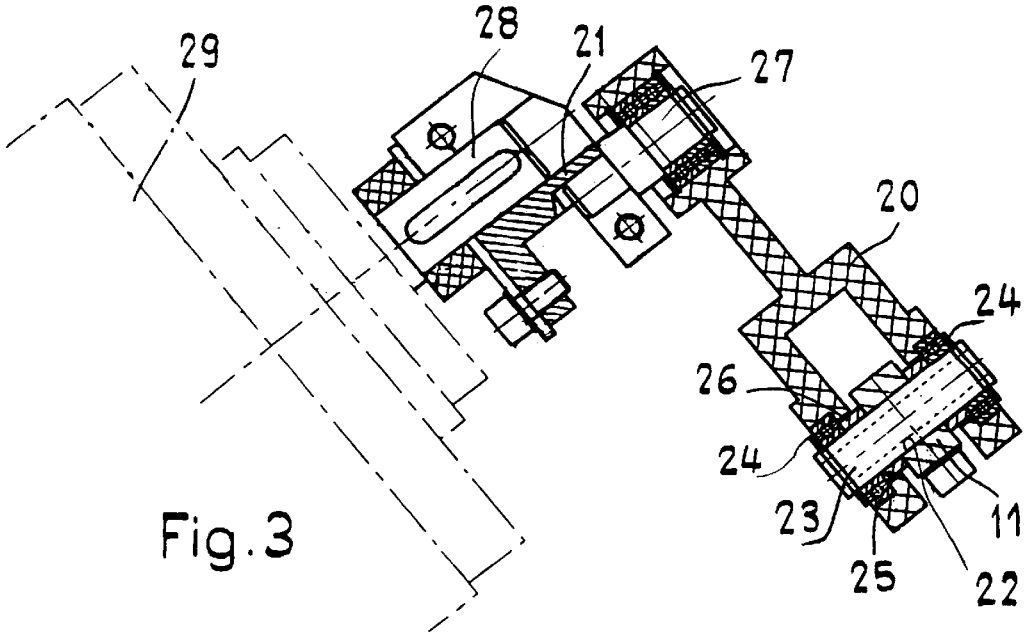

Referring now to FIGS. 1 and 2, there is illustrated a portion of a transport unit 1 or a conveyor for transporting print products 2 which are at their marginal regions releasably clamped in grippers 3 in such a way that they assume a hanging position during transport.

The transport unit 1 is suspended in a guide assembly 4 and comprises chain-like, endless loop pulling means 5 to which equally spaced grippers 3 which can be displaced into an open or closed position, are affixed. The transport unit 1 and the guide assembly 4, respectively, extend with changing directions across at least one processing station which is not shown in the drawing. Two opposed profile rails 6 form a guide assembly 4, wherein a roller 7 which is uniformly distributed on the longitudinal center line of the guide assembly 4 and which is supported by and rotatable about a journal disposed on the articulated axles 8 of the pulling means 5, moves along the profile rails 6. The grippers 3 consist of a stationary gripper element 9 affixed to the pulling means 5 and a moveable gripper element 10. For opening the gripper 3, an actuating element 11 which will be described later, moves the moveable gripper element 10 against the spring force (see torsion spring 34), whereby the moveable gripper element 10 is displaced towards a guide rail 12 extending along the guide assembly 4 for keeping the gripper 3 in the open position.

In FIG. 1, there is depicted a gripper 3 in the closed position with a signature 2 in the transport direction before the actuating device 11, and also a gripper 3 in the open position, wherein the moveable gripper element 10 of the gripper 3 is displaced by the actuating device 11 onto the guide rail 12, keeping the gripper 3 for a short time in the open position. For operating the grippers 3, the grippers 3 are provided with a lever arm 13 fixedly connected to the moveable gripper element 10. On the free end of the lever arm 13, there is disposed a roller 35 driven by an actuating device 11 for opening the gripper 3 and guiding the roller 35 onto the guide rail 12. For this purpose, the end of the actuating device 11 is formed as a curved path 14 which provides for an almost continuous transition of the roller 35 which is disposed on the free end of the lever arm 13 of the moveable gripper element 10, onto the guide rail 12.

The actuating device 11 is formed as a lever, with the end of the lever facing away from the curved path rotatably supported by a support 15 secured to the guide assembly 4 for enabling a pivoting motion. For this purpose, a shaft 16 is provided which extends transversely to the longitudinal direction of the guide assembly 4, with an actuating device 11 acting of the lever arms 13 of the moveable gripper element 10 disposed on each end of the shaft 16. This double-sided embodiment of the apparatus 1 of the invention provides an approximately uniformly distribution on the vertical longitudinal center plane of the guide assembly 4, thereby preventing a twisting effect when the gripper 3 opens. The support 15 includes also two opposing bearing housings 17 with roller bearings 18 for supporting the shaft 16. Each of the actuating devices 11 is connected to the shaft 16 by a wedge 19 and secured against axial displacement on the shaft 16 in a known manner (by a keyed boss).

The dot-dash line in FIG. 1 represents the home position of the actuating device 11. The actuating device 11 is operatively connected with a revolving crank 21 through a connecting rod 20. One end of the connecting rod 20 has the shape of a fork. Approximately in the middle of the actuating device 11, there is provided a bore hole 22 forming a keyed boss, into which a bearing bolt 23 projecting over the actuating device 11 is fixedly inserted. For preventing axial movement, the bearing bolt 23 is secured on the connecting rod 20 with the help of retaining rings 24 and supported in roller bearings 25. A respective spacer ring 26 is disposed between each roller bearing 25 and the actuating device 11.

The opposing end of the actuating device 11 is supported by a journal 27 clamped on the crank 21, also employing roller bearings and providing axial retention. The crank 21, in turn, is disposed on the drive shaft 28 of an electric motor, a servo motor, stepping motor or a stepping switching device 29 for providing step-by-step rotational movement. For displacing the actuating device 11 out of its home position (minimum excursion) into the operating position (maximum excursion) of the apparatus and back to the home position (minimum excursion), the crank has to rotate half a turn (180 degrees), respectively. The crank 21 can be driven by controlling the electric motor 29 or by a stepping drive connected following the electric motor 29, for example through a stepping switching device capable of coupling and braking which is connected to a continuously rotating electric motor 29.

The stepping switching device can be a conventional electromagnetic clutch and brake unit of the brand Mayr which alternately engages the clutch and brakes while the electric motor rotates continuously, using the apparatus of the invention to open the gripper 3.

On the drive shaft 28 of the stepping switching device 29, there is secured a control rotor 30 which cooperates with a stationary initiator 31 for initiating braking of the crank 21 or holding the actuating device 11 in its home position, respectively. The home position of the actuating device 11 can be changed by displacing the initiator 31, as shown in FIG. 1.

The control rotor 30 is formed as a double blade made of two opposing blades 32, 33, wherein one of the blades initiates the home position of the actuating device 11 and the other blade initiates the operating position of the actuating device 11.

The start from the home position or operating position of the actuating device 11 is effected by a control device of the apparatus which can be supervisory.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An apparatus for transporting signatures comprising.

endless loop pulling means (5);

a plurality of grippers (3), each including a lever arm (13), a stationary gripping element (9) and a movable gripping element (10) for providing an open and a close position of each gripper, said plurality of grippers (3) being attached in substantially equal distance from each other to said endless loop pulling means (5);

an actuating device (11) counterbalancing a biasing force of a spring (34) so as to displace each moveable gripping element to the open position said actuating device (11) having two ends, the actuating device (11) being driven from its rest position and acting on the lever arm, wherein one end of said actuating device (11) facing away from the lever arm (13) is pivotally supported, and between its two ends the actuating device (11) is pivotally coupled to a connecting rod (20) which is supported by a revolving crank (21) disposed on a drive shaft (28); and a control rotor (30) secured to said drive shaft (28), wherein said control rotor (3) cooperates with a stationary initiator (31) for initiating one of braking of said revolving crank (21) and holding of said actuating device (11) in the home position.

2. The apparatus according to claim 1, wherein the crank (21) is connected to a rotating drive (29).

3. The apparatus according to claim 2, wherein the rotating drive (29) is formed as a stepping drive.

4. The apparatus according to claim 3, wherein the stepping drive provides step-by step rotational movements, and wherein each of the step-by step rotational movements of the crank (21) is 180°.

5. The apparatus according to claim 4, wherein the step-by-step movement is limited by the maximum and minimum excursion of the actuating device (11).

6. The apparatus according to claim 5, wherein the step-by-step movement can be controlled through a control rotor (30) connected to the rotating drive (29) and cooperating with an initiator (31).

7. The apparatus according to claim 6, wherein the connecting rod (20) has an end connected to the actuating device (11), said end is fork-shaped.

8. The apparatus according to claim 7, wherein the actuating device (11) is secured to a shaft (16) which extends transversely to the direction of motion of the grippers (3) and which is supported by a guide assembly (4) guiding the pulling means (5).

9. The apparatus according to claim 8, wherein the actuating device (11) acting on the moveable gripper element (10) is located on the end which faces the lever arms (13), and is formed as a guide path (14) of a subsequent offset guide rail (12) associated with the opened grippers (3).

10. The apparatus according to claim 9, wherein the guide rail (12) extends parallel to the pulling means (5).

11. An apparatus for transporting signatures comprising:

a guide assembly (6);

endless loop pulling means (5) guided by said guide assembly;

a guide rail (12) offset relative to said guide assembly;

a plurality of grippers (3), each including a lever arm (13), a stationary gripping element (9) and a movable gripping element (10) displacable between an open and a closed position, said plural grippers (3) being attached substantially equidistant from each other to said endless loop pulling means (5);

an actuating device (11) positioned to serve as a guide path to transfer contact of the lever arm of each gripping element (3) from that of said guiding assembly (6) to said offset guide rail (12) while counteracting a biasing force of a spring (34) so as to displace each movable gripping element to the open position, said actuating device (11) having two ends, the actuating device (11) being driven from its rest position and acting on the lever arm (13), wherein one end of said actuating device (11) facing away from the lever arm (13) is pivotally supported, and between its two ends the actuating device (11) is pivotally coupled to a connecting rod (20) which is supported by a revolving crank (21) disposed on a drive shaft (28); and a control rotor (30) secured to said drive shaft (28), wherein said control rotor (3) cooperates with a stationary initiator (31) for initiating one of braking of said revolving crank (21) and holding of said actuating device (11) in the home position.

* * * * *